US011259983B2

(12) United States Patent
Linge et al.

(10) Patent No.: US 11,259,983 B2
(45) Date of Patent: Mar. 1, 2022

(54) SPRING-LOADED TIP FOR A WALKING AID

(71) Applicants: Julie Linge, Winnipeg (CA); Romel Lantano, Selkirk (CA); Romeo Lantano, Winnipeg (CA)

(72) Inventors: Julie Linge, Winnipeg (CA); Romel Lantano, Selkirk (CA); Romeo Lantano, Winnipeg (CA)

( * ) Notice: Subject to any disclaimer, the term of this patent is extended or adjusted under 35 U.S.C. 154(b) by 0 days.

(21) Appl. No.: 17/242,797

(22) Filed: Apr. 28, 2021

(65) Prior Publication Data

US 2021/0346231 A1 Nov. 11, 2021

Related U.S. Application Data

(60) Provisional application No. 63/129,995, filed on Dec. 23, 2020.

(51) Int. Cl.

| | |
|---|---|
| ***A61H 3/02*** | (2006.01) |
| ***A45B 9/04*** | (2006.01) |
| *A45B 9/00* | (2006.01) |

(52) U.S. Cl.

CPC ..... *A61H 3/0277* (2013.01); *A45B 9/04* (2013.01); *A61H 3/0288* (2013.01); *A45B 2009/007* (2013.01)

(58) Field of Classification Search

CPC ..... A45B 9/04; A61H 3/0288; A61H 3/0277
See application file for complete search history.

(56) References Cited

U.S. PATENT DOCUMENTS

| | | | | |
|---|---|---|---|---|
| 2,675,014 | A * | 4/1954 | Powers | A61H 3/0277 135/82 |
| 2,888,022 | A * | 5/1959 | Fanning | A61H 3/0277 135/82 |
| 4,510,957 | A * | 4/1985 | Frank | A45B 9/04 135/79 |
| 6,883,530 | B2 * | 4/2005 | Kawakami | A45B 9/04 135/82 |
| 7,823,599 | B2 * | 11/2010 | Thibodeau | A45B 9/04 135/84 |
| 8,820,339 | B2 * | 9/2014 | Goodwin | A45B 9/04 135/84 |
| 9,226,556 | B1 * | 1/2016 | Chien | A45B 9/04 |
| 9,326,572 | B2 * | 5/2016 | Daily | A45B 7/00 |
| 9,681,714 | B1 * | 6/2017 | Yeh | A45B 9/02 |
| 9,974,367 | B2 * | 5/2018 | Liu | A45B 9/04 |
| 2017/0311688 | A1 * | 11/2017 | Chen | A45B 9/04 |

* cited by examiner

*Primary Examiner* — Noah Chandler Hawk
(74) *Attorney, Agent, or Firm* — Michael R Williams; Kyle R Satterthwaite; Ade & Company Inc.

(57) ABSTRACT

A spring-loaded tip attachment for a walking aid features a compression spring having axially opposing proximal and distal ends, a mount connected to the proximal end of said compression spring and configured for attachment to a shaft of said walking aid at or proximate a bottom end thereof, and a shoe connected to the distal end of said compression spring for spring-loaded contact of said shoe with a ground or floor surface during use of said walking aid. A plurality of attachments are respectively configured with different spring rates intended for users within different body weight categories. Attachments with greater spring rates are given to users in higher-weight categories, and attachments with lesser spring rates are given to users in lower-weight categories.

22 Claims, 2 Drawing Sheets

SPRING-LOADED TIP FOR A WALKING AID

CROSS-REFERENCE TO RELATED APPLICATIONS

This application claims priority benefit under 35 U.S.C. 119(e) of U.S. Provisional Patent Application No. 63/129,995, filed Dec. 23, 2020, the entirety of which is incorporated herein by reference.

FIELD OF THE INVENTION

The present invention relates generally to walking aids, for example canes and crutches, and more particularly to bottom tips thereof that are installed at bottom ends of the shafts of such walking aids to impart frictional gripping action with the ground or floor.

BACKGROUND

Canes and crutches are unquestionably valuable tools for people with mobility issues, allowing those with chronic challenges to maintain their independence, and allowing those recovering from injury or surgical procedures to undergo appropriate physical rehabilitation. However, use of such walking aids can be challenging, uncomfortable, and even painful, particularly for those suffering with arthritic fingers, wrists, or hands, and/or forearm or shoulder pain.

Accordingly, it is desirable to improve on the design of conventional walking aids, particularly with the goal of at least partially alleviating such discomfort.

SUMMARY OF THE INVENTION

According to one aspect of the invention, there is provided a spring-loaded tip attachment for a walking aid, said attachment comprising:

a compression spring having axially opposing proximal and distal ends;

a mount connected to the proximal end of said compression spring and configured for attachment to a shaft of said walking aid at or proximate a bottom end thereof; and a shoe connected to the distal end of said compression spring for spring-loaded contact of said shoe with a ground or floor surface during use of said walking aid.

According to another aspect of the invention, there is provided a walking aid comprising:

an elongated shaft;

installed on said elongated shaft, a spring-loaded tip comprising:

- a compression spring having axially opposing proximal and distal ends, of which the proximal end is secured to said elongated shaft and the distal end is situated axially beyond a terminal bottom end of said elongated shaft; and
- a shoe connected to the distal end of said compression spring for spring-loaded contact of said shoe with a ground or floor surface during use of said walking aid.

BRIEF DESCRIPTION OF THE DRAWINGS

One embodiment of the invention will now be described in conjunction with the accompanying drawings in which.

DETAILED DESCRIPTION

Figure 1:
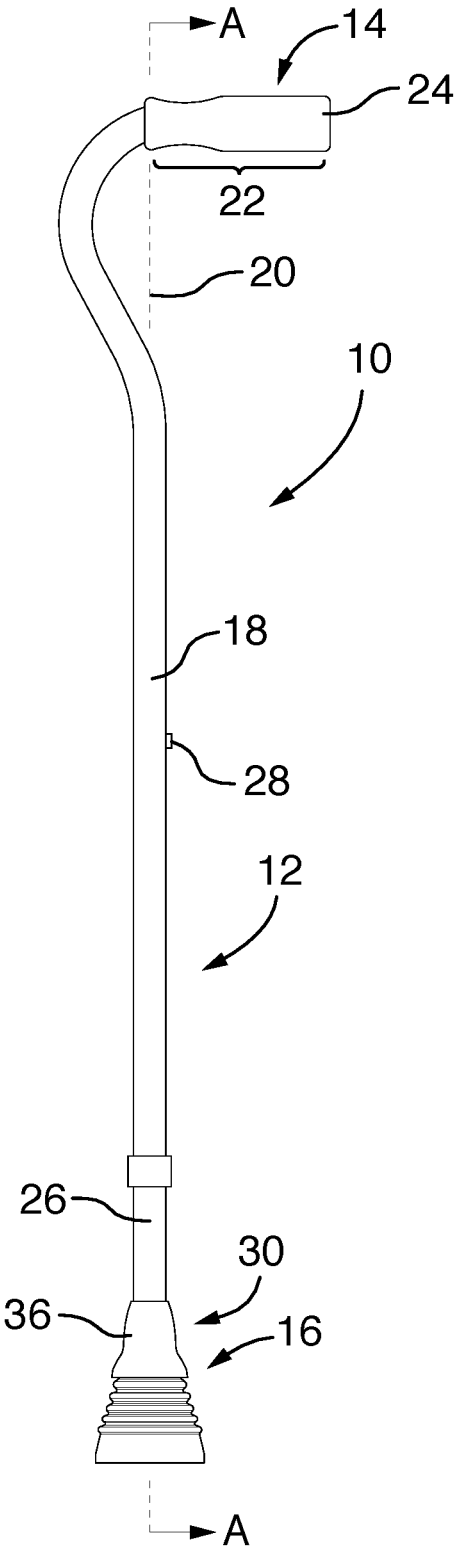
FIG. 1 is an elevational view of a walking cane equipped with a removable spring-loaded tip attachment of the present invention.
Figure 2:
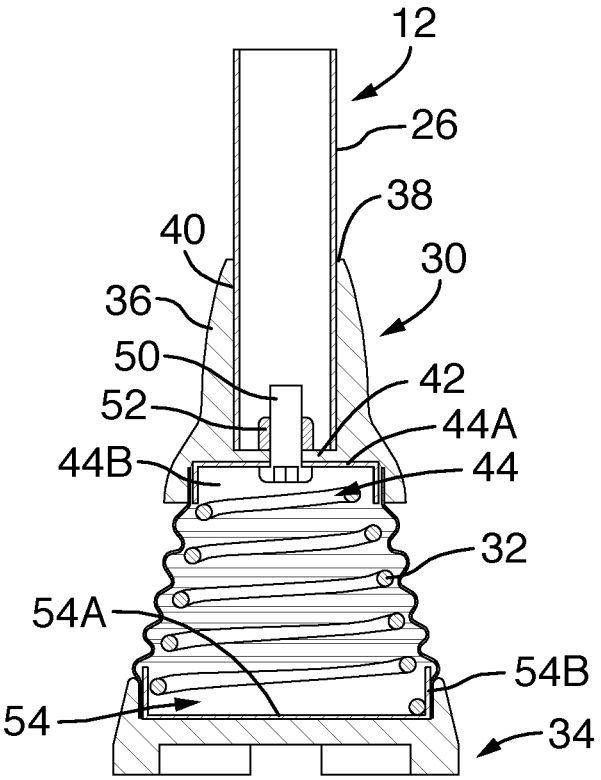
FIG. 2 is a partial elevational view of the walking cane of FIG. 1, cross-sectioned along line A-A thereof to reveal internal details of the spring-loaded tip attachment.
Figure 3:
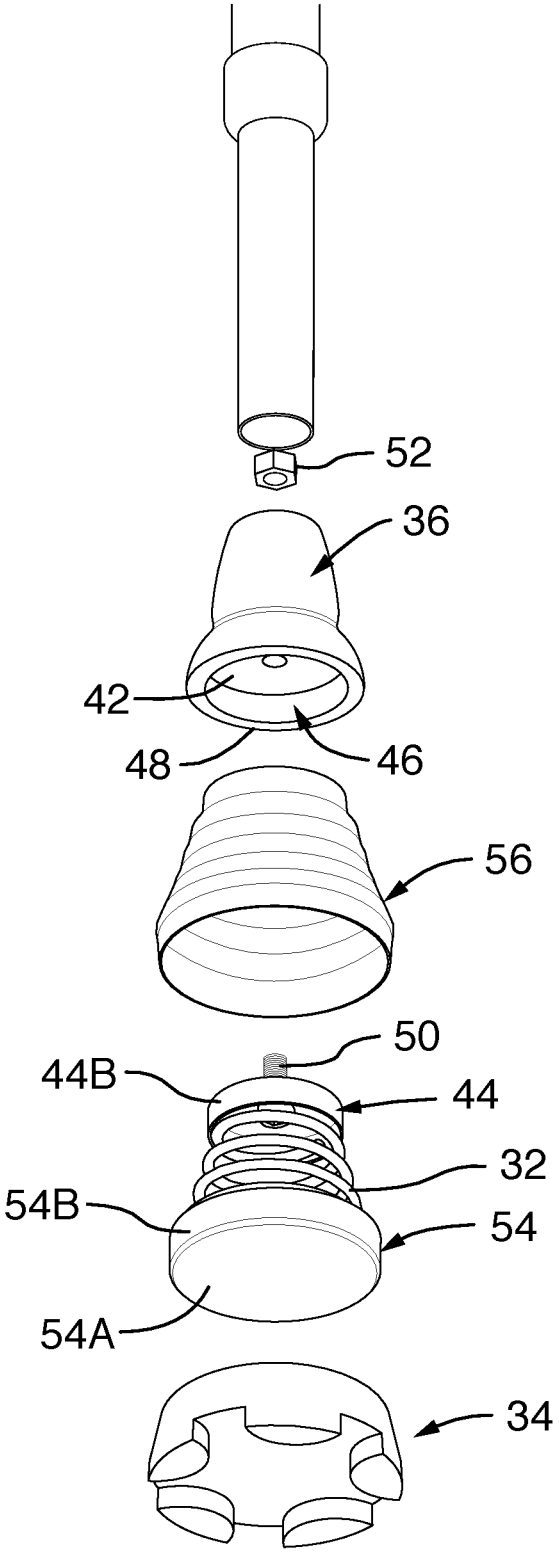
FIG. 3 is a partial exploded perspective view of the walking cane of FIG. 1, illustrating assembly of the spring-loaded tip attachment.

The appended drawings show a walking cane 10, which in conventional fashion features an elongated shaft 12 having a handle 14 affixed thereto at a top end thereof, and a removable tip attachment 16 that is removably secured thereto at an axially-opposing bottom end of the shaft 12. In illustrated example, the cane 10 is of a type where a body of the handle is a seamlessly integral extension of an outer tube 18 of the shaft 12, a majority of which extends linearly along a central longitudinal axis 20 of the cane. The handle body is bent in deviating fashion from this linear majority of the shaft's outer tube so that a terminal grip segment 22 of the handle lies perpendicularly transverse of the longitudinal axis 20 at the top end of the cane 10. Here, the handle body is externally equipped with a resilient grip cover 24 for comfortable grip of the handle in the hand of a user. In the illustrated example, the shaft 12 of the cane is a telescopically adjustable shaft of user-selectable length, and thus features an inner tube 26 that is telescopically received within the outer tube 18 for selective sliding motion back and forth therein to adjust the degree to which the inner tube telescopically protrudes from an open bottom end of the outer tube. The inner tube 26 is lockable at different telescopic positions of varying extension from the outer tube by a suitable locking mechanism, preferably of a self-locking type, for example by a spring-loaded ball detent 28.

The can features in the preceding paragraph are of a conventional nature, and are described purely in the interest of setting a general context of the present invention, the particular novelty of which resides in a spring-loaded design of the tip 16 attachment at the bottom end of the shaft 12. It will therefore be appreciated that the particular type of cane described and illustrated is just one non-limiting example of a possible application for the novel spring-loaded tip attachment 16, and that the same tip attachment 16 may be similarly installed on the shafts of canes, crutches or other walking aids of various design. The longitudinal axis 20 on which the shaft 12, or at least a linear segment thereof, is centered denotes an axial direction relative to which the location and orientation of various other components are described herein.

The tip attachment 16 is embodied in a multi-piece assembly comprising, in top-to-bottom order in the axial direction, an upper mount 30 by which the attachment 16 is secured to the shaft 12 of the cane 10, a coiled compression spring 32 having a proximal upper end coupled to the mount 30, and a lower shoe 34 that is coupled to a distal lower end of the spring that resides axially opposite the proximal upper end thereof.

The shoe 34 is composed of rubber or other resilient material for making contact with the underlying floor or ground surface during use of the cane, and may be configured with variety of different possible shapes. The mount 30 features a tip body 36 that is also composed of rubber or other resilient material, and whose shape may be similar to conventional cane tips, whereby the mount is readily substitutable for an existing conventional tip of an existing cane by simply slipping the tip body 36 onto the bottom end of the cane shaft 12 in place of a similar conventional slip-on cane tip. However, in the other embodiments, the manner in which the mount 30 is installed on the shaft 12 of the cane 10, and accordingly the shape and configuration of the mount 30, may vary, including embodiments where the spring-loaded tip attachment 16 is incorporated into the cane at the time of manufacture, rather than installed as an aftermarket replacement for an conventional cane tip of a user's existing cane.

The spring 32 operates between the mount 30 and the shoe 34 in a manner normally residing in an uncompressed state holding the shoe 34 at a predetermined axial distance from the mount 30. From this default uncompressed state, the spring 32 is axially compressible by exertion of the user's body weight of the shaft of the cane 10 during otherwise normal use thereof. This compression of the spring allows displacement of the shoe 34 axially toward the mount 30 under such exertion of body weight on the shaft 12 of the cane 10, during which the compression of the spring 32 absorbs some of that exerted body weight, thereby providing increased comfort for the user. The impact force of the shoe 34 against the ground or floor surface with each step of the user's walking stride is also at least partially absorbed by the spring 32, thus reducing transmission of shock forces up the shaft and into the handle, which also contributes to improved user comfort. In addition to these force absorption functions of the spring associated with its axial compression, the spring 32 can also radially deflect out its default position coiled concentrically about the longitudinal axis 20 of the cane, whereby the bottom of the shoe 34 can maintain fully flush contact with the ground or floor surface over a greater range of the cane's angular stroke in a normal walking step, thus potentially improving the cane's frictional interaction with the ground or floor and thereby improving the overall stability of the cane throughout the user's walking stride.

The tip body 36 features an open top end 38 from which a hollow cylindrical bore 40 penetrates axially into the tip body to receive the bottom end of the cane shaft 12, as defined by the bottom end of the shaft's inner tube 26 in the telescopic shaft structure of the illustrated example. The diameter of this bore 40 closely conforms to the outer diameter of the cane shaft 12, at least at the bottom end thereof, whereby receipt of the shaft's bottom end in the bore 40 of the tip body 36 frictionally secures the mount 30 to the shaft 12 of the cane. All the other components of the spring-loaded tip attachment 16 are in turn carried on the shaft 12 of the cane 10 by the tip body 36 of the mount 30. The hollow bore 40 of the tip body 36 terminates in a substantially closed end-wall 42 at a bottom end of the bore 40, against which the bottom end of the cane shaft 12 bottoms out. This end-wall 42 of the bore 40 has a central fastener hole therein through which the remainder of the spring-loaded tip attachment is coupled to the tip body 36 of the mount 30 as described in more detail below.

To attach the spring 32 to the tip body 36, the mount 30 also includes a metal or otherwise rigid spring base 44 to which the proximal upper end of the spring 32 is attached. A top plate 44A of the spring base 44 is seated against the closed-end wall 42 of the of the tip body 36, but at the underside thereof that resides oppositely of the hollow bore 40 in which the bottom end of the cane shaft 12 is received. The bottom end of the tip body 36 has an axially recessed circular cavity 46 therein in which the spring base 44 is received in a position placing its top plate 44A in abutted relation against the underside of the tip body's closed end-wall 42. Here, the spring base 44 is circumferentially surrounded by an outer rim wall 48 of the circular cavity 46.

A threaded male screw fastener 50 penetrates axially upward through a center of the top plate 44A of the spring base 44, whereby a threaded stem of this male screw fastener 50 stands upwardly from the spring base 44 to reach axially upward through the fastening hole in the center of the tip body's end-wall 42. Inside the hollow bore 40 of the tip body 36, and thus inside the hollow interior of the cane shaft's bottom end when the tip body 36 is installed thereon, the threaded stem of the male screw fastener 50 is engaged by an internally threaded female fastener 52 that is tightened against the topside of the tip body's end-wall 42. The two engaged fasteners 50, 52 thereby clamp the spring base's top plate 44A snug against the underside the tip body's end wall 42, thereby fastening the spring base 44 and the attached spring 32 to the tip body 36. The uppermost coil of the spring 32 is attached to the spring mount 44 in a position abutting against an underside of the top plate 44A, and captured within the confines of a cylindrical periphery wall 44B of the spring mount 44 that depends downward from the top plate 44A around the perimeter thereof. The spring mount 44 therefore caps off the top end of the spring 32.

At the distal lower end of the spring 32, the lowermost coil thereof is likewise received by and attached to a metal or otherwise rigid shoe holder 54 that is of similar construction to the spring base, but resides in an inverted orientation relative thereto in order to cap off the bottom, to the spring base 44. Instead of a top plate 44A from which a hanging peripheral wall 44B depends downward, the shoe holder 54 thus has a bottom plate 54A from which an upstanding peripheral wall 54B stands upright. The lowermost coil of the spring 32 is thus received by and attached to the shoe holder 54 within the confines of the peripheral wall 54B of the shoe holder 54, in abutted relation against the topside of the bottom plate 54A thereof. The shoe 34 has an internal cavity recessed axially thereinto from a top end thereof, and the shoe holder 54 is received within this internal cavity of the shoe in friction fit and/or bonded fashion to secure the shoe 34 to the shoe holder 54 at the distal lower end of the spring 32.

To protect the spring 32 from the elements and other contaminants (e.g. dirt, sand, or other debris), the illustrated embodiment of the spring-loaded tip-attachment also features a protective shroud 56 of accordion or bellows-like shape that circumferentially surrounds the spring 32 in an axially-confined position between the shoe 34 and the tip body 36 of the mount 30. The shroud 56 is axially compressible and expandable in concert with the compression spring 32. Preferably the spring 32 is at least partially visible through the protective shroud 56, whereby potential customers are readily able to visually detect and understand the spring-loaded nature of the novel tip attachment 16, and thereby differentiate the product from conventional cane tips lacking such spring-loaded functionality. To achieve such visibility of the spring, the shroud 56 may be composed entirely of transparent or translucent material, thus enabling visual detection of the spring over a full 360-degree viewing range around the tip attachment 16. Or, if a main body of the shroud is opaque, one or more window openings may be provided somewhere in the shroud body to enable visual detection of the spring through such window opening(s), each of which may be covered with a transparent or translucent window covering that is materially distinct from the shroud's main body, thus maintaining full isolation of the internal spring space from the surrounding ambient environment outside the shroud.

Canes are typically manufactured with a fixed, standardized outer shaft diameter, at least at the bottom end of the shaft, so that different cane tips can be readily swapped out for one another. Accordingly, the illustrated embodiment and its tip body 36 enable easy, friction-fit, universal mounting of the spring-loadable tip attachment 16 to any standard-diameter cane in entirety interchangeable fashion for any ordinary conventional cane tip. However, in preferred embodiments, multiple models of spring-loaded attachment are preferably made, and differ from one another at least in the spring rate (aka spring constant) of the compression spring used. Springs with a greater spring rate would be used for models that are intended for users whose body weights fall into a higher-weight category, while springs with a lesser spring rate would be used for models that are intended for users whose body weights fall into a lower-weight category. In a non-limiting example of such body weight and spring rate categorization, users with a body weight of 90-130 lbs are classified in a low-weight category for which a low spring rate of 15 lbs/inch is prescribed; users with a body weight of 130-175 lbs are classified in a mid-weight category for which a medium spring rate of 30 lbs/inch is prescribed; and users with a body weight of 175-300 lbs, or more, are classified in a high-weight category for which a high spring rate of 50 lbs/inch is prescribed.

The different models may be mass produced and fully assembled in advance, with end-users thus purchasing available pre-assembled product from an existing inventory of the appropriate model for their weight class. Alternatively, the products may be inventoried as unassembled or partially assembled kits, whereupon an appropriate spring for a customer-ordered product is only selected upon receipt of a customer order designating their particular weight class, whereupon the product may be assembled prior to customer fulfillment, or may be shipped to the customer as an unassembled or partially assembled kit for final end-user assembly using the selected spring dictated by the specified customer weight or customer-selected weight class found in the customer order.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A spring-loaded tip attachment for a walking aid, said attachment comprising:

a compression spring having axially opposing proximal and distal ends;

a mount to which the proximal end of said compression spring is attached, said mount being configured for attachment to a shaft of said walking aid at or proximate a bottom end thereof to thereby secure said compression spring to said shaft of the walking aid;

a shoe attached to the distal end of said compression spring for spring-loaded contact of said shoe with a ground or floor surface during use of said walking aid; and a protective shroud having an accordion or bellows shape, and spanning circumferentially around the compression spring in an axially confined state between the mount and the shoe, said protective shroud being axially compressible and expandable in concert with the compression spring;

wherein through attachment of the compression spring's proximal and distal ends to the mount and the shoe, respectively, the mount and the shoe are secured together by said compression spring.

2. The attachment of claim 1 wherein said mount comprises a tip body having an open end from which a hollow bore extends axially into the mount to enable receipt of the bottom end of said shaft into said hollow bore through the open end of the tip body, the hollow bore terminates at a closed end wall that is abutted on a side thereof opposite the hollow bore by a top end of a spring base to which the proximal end of the compression spring is attached, the top end of the spring base his held against said closed end wall by a threaded male fastener that is engaged in a tightened state with a threaded female element, and the top end of the spring base and the closed end wall of the hollow bore are clamped together between a head of said male fastener and said female threaded element.

3. The attachment of claim 2 wherein, among said compression spring, said protective shroud and said male fastener, only said compression spring and said shroud span from the tip body to the shoe.

4. The attachment of claim 1 wherein said compression spring is at least partially visible through said shroud.

5. The attachment of claim 1 in combination with said walking aid.

6. The combination of claim 5 wherein said walking aid is a cane.

7. The combination of claim 5 wherein said walking aid is a crutch.

8. A walking aid comprising:

an elongated shaft; and installed on said elongated shaft, a spring-loaded tip according to claim 1.

9. The walking aid of claim 8 wherein said walking aid is a cane.

10. The walking aid of claim 8 wherein said walking aid is a crutch.

11. The attachment of claim 1 wherein the mount and the shoe are interconnected solely by the compression spring and the shroud.

12. The attachment of claim 1 comprising a shoe holder that is disposed within a cavity of the shoe and to which the distal end of the compression spring is attached, thereby securing the shoe to the tip body via the compression spring.

13. A spring-loaded tip attachment for a walking aid, said attachment comprising:

a compression spring having axially opposing proximal and distal ends;

a mount to which the proximal end of said compression spring is attached, said mount being configured for attachment to a shaft of said walking aid at or proximate a bottom end thereof to thereby secure said compression spring to said shaft of the walking aid;

a shoe attached to the distal end of said compression spring for spring-loaded contact of said shoe with a ground or floor surface during use of said walking aid; and a protective shroud having an accordion or bellows shape spanning circumferentially around the compression spring in an axially confined state between the mount and the shoe, said protective shroud being axially compressible and expandable in concert with the compression spring;

wherein attachment of the proximal end of the compression spring to the mount is secured at least partly by a threaded male fastener, and among said compression spring, said protective shroud and said threaded male fastener, only said compression spring and said protection shroud span from the mount to the shoe.

14. The attachment of claim 13 wherein the mount and the shoe are interconnected solely by the compression spring and the shroud.

15. The attachment of claim 13 wherein said compression spring is at least partially visible through said shroud.

16. The attachment of claim 13 comprising a shoe holder that is disposed within a cavity of the shoe and to which the distal end of the compression spring is attached, thereby securing the shoe to the tip body via the compression spring.

17. The combination of claim 16 wherein said walking aid is a cane.

18. The combination of claim 16 wherein said walking aid is a crutch.

19. The attachment of claim 13 in combination with said walking aid.

20. A walking aid comprising:

an elongated shaft; and installed on said elongated shaft, a spring-loaded tip according to claim 13.

21. The walking aid of claim 20 wherein said walking aid is a cane.

22. The walking aid of claim 20 wherein said walking aid is a crutch.

* * * * *